US006829849B2

(12) United States Patent
Watanabe

(10) Patent No.: US 6,829,849 B2
(45) Date of Patent: Dec. 14, 2004

(54) ARM LOWERING MOTION RESTRICTING DEVICE FOR WORKING VEHICLE

(75) Inventor: Osamu Watanabe, Sakaki-machi (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 0 days.

(21) Appl. No.: 10/638,965

(22) Filed: Aug. 11, 2003

(65) Prior Publication Data

US 2004/0148816 A1 Aug. 5, 2004

(30) Foreign Application Priority Data

Aug. 21, 2002 (JP) ..... 2002-240044

(51) Int. Cl.[7] ..... E02F 3/96; B66C 23/00

(52) U.S. Cl. ..... 37/403; 414/722

(58) Field of Search ..... 37/403–410, 416, 37/466, 442; 414/713, 722–726, 680, 685; 92/14–27

(56) References Cited

U.S. PATENT DOCUMENTS 3,982,648 A * 9/1976 Luedtke et al. ..... 414/713
4,039,093 A * 8/1977 Schmitz et al. ..... 414/680
4,043,253 A * 8/1977 Albright et al. ..... 92/25
5,009,566 A * 4/1991 Asche ..... 414/722

* cited by examiner

*Primary Examiner*—Robert E Pezzuto
(74) *Attorney, Agent, or Firm*—Klauber & Jackson

(57) ABSTRACT

The arm lowering motion restricting device 40 comprises an arm restricting member 41 which can be freely swung upward and downward, one end portion of which is pivotably connected to the arm 21, and which extends so as to cover the upper surface of the raising and lowering cylinder 23, a locking pin 50 which is detachably passed through the lower end portion of the arm restricting member 41, and a torsion coil spring 60 which is attached to the upper portion of the tip end of the arm restricting member 41. When the raising and lowering cylinder 23 is extended so that the tip end portion of the arm restricting member 41 contacts the end surface **23*b*1 of the cylinder tube 23*b* on the cylinder rod side, the retraction of the raising and lowering cylinder 23 is restricted. In such a state, when the first arm part 61 of the torsion coil spring 60 is caused to abut against the upper surface of the tip end of the cylinder tube 23*b*, the second arm part 62 is latched on the latching pin 45 of the arm restricting member 41, and the raising and lowering cylinder 23 is extended, the arm restricting member 41 is caused to swing upward so that the restriction of the retraction of the raising and lowering cylinder 23** is released.

8 Claims, 4 Drawing Sheets

ARM LOWERING MOTION RESTRICTING DEVICE FOR WORKING VEHICLE

RELATED APPLICATIONS

The present application claims priority from Japanese Patent Application Serial No.2002-240044 filed on Aug. 21, 2002. Applicant claims priority under 35 U.S.C. §119 as to said Japanese application, and the entire disclosure of that application is incorporated herein by reference.

FIELD OF THE INVENTION

The present invention relates to an arm lowering motion restricting device for a working vehicle. More particularly, the present invention relates to an arm lowering motion restricting device for a working vehicle which has arms that are pivotably connected to a mobile vehicle so that these arms can be freely raised and lowered, a working tool that is detachably attached to the tip end portions of these arms, and raising and lowering cylinders that cause the raising and lowering motion of these arms.

BACKGROUND OF THE INVENTION

Generally, working vehicles in which a bucket that can be freely swung upward and downward is attached to the tip end portion of an arm that can be freely raised and lowered are used in order to dig in the ground, move earth that has been dug from the ground and the like. For example, such working vehicles comprise an operating cabin which is disposed on the central upper portion of a mobile moving body, a pair of arms which extend in the forward-rearward direction on both the left and right sides of the operating cabin, and which are pivotably connected so that these arms can be freely raised and lowered, a bucket which is detachably attached to the tip end portions of these arms, and raising and lowering cylinders which cause the raising and lowering motion of these arms. A reinforcing member which straddles the space between the arms is attached to the tip end portions of the arms, the cylinder rod end portions of the raising and lowering cylinders are pivotably connected to the tip end portions of the arms, and the cylinder tube end portions of the raising and lowering cylinders are pivotably connected to the moving body, so that the arms are raised and lowered in accordance with the extension and retraction of the raising and lowering cylinders.

In such working vehicles, a construction in which an engine, a hydraulic pump and the like are disposed beneath the operating cabin, and the operating cabin is attached so that this operating cabin can be swung upward and downward in order to facilitate maintenance of the hydraulic pump and the like, is also generally known. In this case, the operating cabin is pivotably connected to the moving body via dampers or the like, so that the operating cabin can be easily swung upward and downward by the manual operation of the operator with the aid of the dampers. In order to perform maintenance on the hydraulic pump and the like, the arms are first swung into the lower position so that the bucket is placed on the surface of the ground. Then, the bucket is removed from the arms. Next, the arms are caused to move upward so that the reinforcing member connected between the arms is moved to the upper position, thus forming a space in which the operator can move in a position in front of the vehicle. Then, the operator swings the operating cabin upward so that the hydraulic pump and the like positioned beneath the operating cabin are exposed, and performs maintenance work on the hydraulic pump and the like.

When maintenance work is being performed in this way, it is necessary to hold the arms in a state in which the arms have been raised upward. Here, since the extension and retraction operation of the raising and lowering cylinders that raise and lower the arms is controlled by a switching valve installed in the hydraulic pressure circuit, the hydraulic circuit must be cut off by this switching valve so that the extension and retraction operation of the raising and lowering cylinders is stopped in order to hold the arms in the raised position. However, even if the extension and retraction operation of the raising and lowering cylinders is thus stopped and held by the switching valve, there is a danger that oil may leak from gaps around the outer circumference of the spool of the switching valve so that there is a gradual retraction of the raising and lowering cylinders. In most cases, therefore, an arm lowering motion restricting device which securely restricts the retraction of the raising and lowering cylinders by mechanical means is mounted on the working vehicle.

Such arm lowering motion restricting devices include devices which comprise an arm restricting member, a locking pin and a tension spring. Furthermore, one end of the arm restricting member is pivotably connected to one of the arms, and the arm restricting member extends between this arm and the raising and lowering cylinder so that the upper surface of the raising and lowering cylinder is covered, with the arm restricting member being free to swing upward and downward. The other end of the arm restricting member is placed in a state in which this end contacts the cylinder tube of the corresponding raising and lowering cylinder, so that the retraction of the raising and lowering cylinder is mechanically restricted. The locking pin is inserted (in a manner that allows free insertion or removal) into the tip end portions of a pair of protruding parts formed on the arm restricting member, which protrude downward beyond the lower surface part of the cylinder rod of the raising and lowering cylinder so that the left and right sides of the cylinder rod are covered in a state in which the tip end portion of the arm restricting member is caused to contact the tip end surface of the cylinder tube, thus restricting the swinging of the arm restricting member in the direction that causes the tip end portion of the arm restricting member to move away from the tip end surface of the cylinder tube. One end portion of the tension spring is attached to the tip end portion of the arm restricting member, and the other end portion of the tension spring is attached to the locking pin, which is inserted (in a manner that allows free insertion and removal) into a bracket that protrudes downward from the undersurface of the arm in a state in which the tip end portion of the arm restricting member is caused to contact the tip end surface of the cylinder tube, so that the arm restricting member is pulled upward with respect to the raising and lowering cylinder.

Here, in order to release the restriction of the retraction of the raising and lowering cylinder from the state in which the retraction of the raising and lowering cylinder is restricted by the contact of the tip end portion of the arm restricting member with the tip end surface of the cylinder tube, the locking pin that is inserted into the arm restricting member is pulled out, the other end portion of the tension spring is fastened to the locking pin, and the locking pin is inserted into the bracket in this state. Then, when the raising and lowering cylinder is extended so that the tip end portion of the arm restricting member is caused to separate from the tip end surface of the cylinder tube, the tension spring causes the arm restricting member to swing upward as a result of the tensile force of the spring, so that the tip end portion of the arm restricting member is removed from the tip end surface of the cylinder tube, thus releasing the restriction of the retraction of the raising and lowering cylinder.

Thus, in order to release the restriction of the retraction of the raising and lowering cylinder, the locking pin is removed from the arm restricting member, after which the tension spring is fastened to the locking pin, and the locking pin is inserted into the bracket. However, when the locking pin is inserted into the bracket, the tension spring is in an extended state. Accordingly, the locking pin must be inserted into the bracket against the tension of the tension spring, so that this work is bothersome.

SUMMARY OF THE INVENTION

The present invention was devised in light of such problems; it is an object of the present invention to provide an arm lowering motion restricting device in which the releasing operation that releases the restriction of the retraction of the raising cylinder by the arm restricting member is easy.

In the present invention, a working vehicle comprises a vehicle, an arm which is attached to the vehicle so as to be freely raised and lowered, and a raising and lowering cylinder which is attached between the vehicle and the arm to raise and lower the arm, in which the tip end of a cylinder rod constituting the raising and lowering cylinder is pivotably connected to the arm, and a cylinder tube constituting the raising and lowering cylinder is pivotably connected to the vehicle, so that the arm can be raised and lowered by extending and retracting the cylinder rod from and into the cylinder tube. The arm lowering motion restricting device comprises an arm restricting member one end of which is pivotably connected to the arm, and which extends between the arm and the raising and lowering cylinder so as to cover the upper surface of the raising and lowering cylinder, and is free to swing upward and downward about the position where the one end is pivotably connected to the arm; a swinging motion restricting member which restricts the swinging motion of the arm restricting member in the direction where the arm restricting member is separated from the cylinder rod in a state in which the arm restricting member has swung into a position where the arm restricting member covers the top of the cylinder rod; and a swinging motion urging member which is attached to the other end of the arm restricting member, and which urges the arm restricting member in the direction where the arm restricting member is separated from the cylinder rod in a state in which the arm restricting member has swung into a position where said arm restricting member covers the top of the cylinder rod.

In the arm lowering motion restricting device constructed as described above, the arm restricting member covers the cylinder rod in a state in which the amount of extension of the raising and lowering cylinder has reached a specified amount, and the abovementioned second end portion of the arm restricting member can restrict the retraction of the raising and lowering cylinder by contacting the tip end surface of the cylinder tube. In this case, the swinging motion restricting member maintains a state in which the arm restricting member covers the cylinder rod, so that the retraction of the cylinder rod can be securely restricted. Meanwhile, when this restriction is to be released, if the restriction by the swinging motion restricting member is released, and the raising and lowering cylinder is slightly extended, the urging force of the swinging motion urging member causes the arm restricting member to swing in the direction that separates the arm restricting member from the cylinder rod, so that the restriction is automatically released. Accordingly, the work of releasing the restriction effected by the arm restricting member is simple.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Figure 1B:
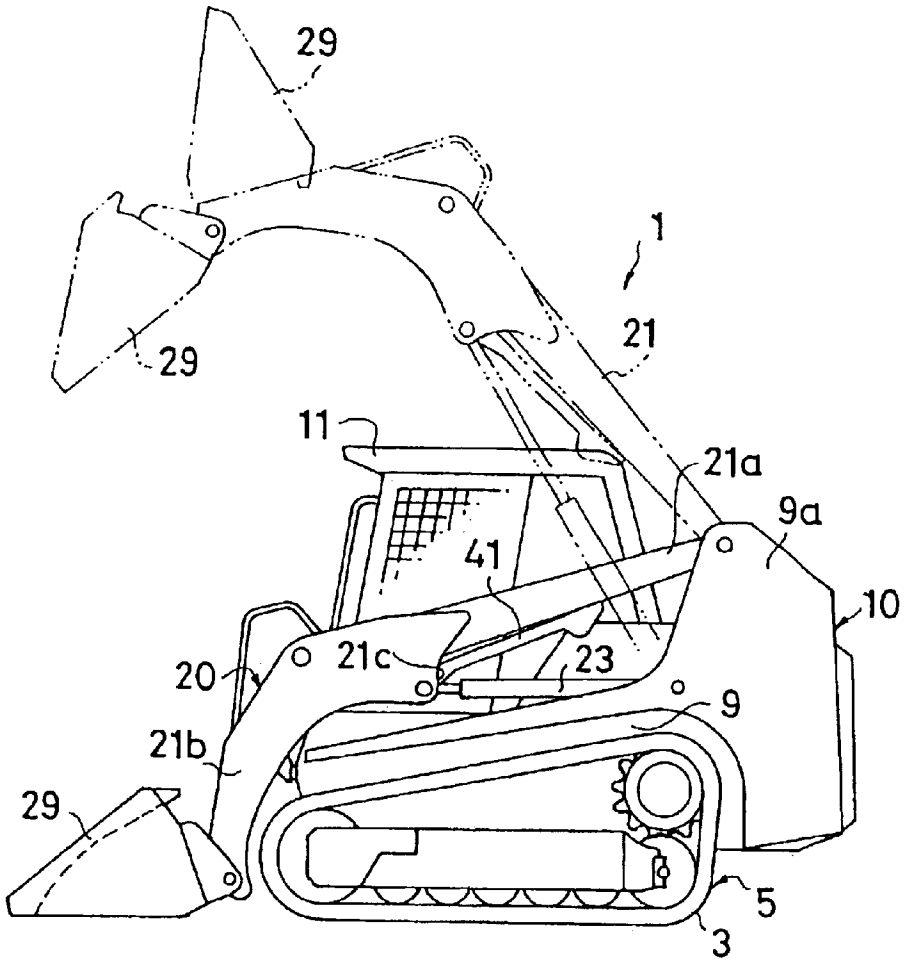
FIG. 1 shows a shovel loader on which the arm lowering motion restricting device of the present invention is mounted, with FIG. 1A being a front view of the shovel loader, and FIG. 1B being a left side view of the shovel loader.

A preferred embodiment of the present invention will be described below with reference to FIGS. 1 through 4. In this embodiment, the arm lowering motion restricting device of the present invention is used in a shovel loader which is used to dig in the ground, and to move earth or the like that has been dug from the ground. First, therefore, the shovel loader on which the arm lowering motion restricting device of the present invention is mounted will be described before this arm lowering motion restricting device is described.

As is shown in FIG. 1, the shovel loader 1 is constructed so that this shovel loader comprises a pair of left and right running apparatuses 5 which have respective covering tracks 3, a main body frame 9 to which these left and right running apparatuses are attached, a loader apparatus 20 which is attached to the main body frame 9, and an operator cabin 11 which is disposed on the central upper portion of the main body frame 9. Furthermore, the running apparatuses 5 and main body frame 9 will hereafter be referred to together as the "vehicle 10".

The operator cabin 11 has a box shape, and the side at the front of the vehicle is open. An operator seat 12 in which the operator (not shown in the figures) sits facing the side of the loader apparatus 20 is disposed inside the operator cabin 11. An operating apparatus 14 which controls the driving of the loader apparatus 20 is disposed on the left and right of the operator seat 12. The operating apparatus has a left operating lever 14*a* and a right operating lever 14*b*; when the left operating lever 14*a* is operated by a tilting movement, the running apparatuses 5 are actuated, and when the right operating lever 14*b* is operated by a tilting movement, the arms 21 of the loader apparatus 20 are raised or lowered, and the bucket 29 is caused to perform a digging operation or earth discharging operation.

The operator cabin 11 is pivotably connected to the main body frame 9 so that the operator cabin 11 can be swung upward and downward about the rear portion of the main body frame 9. In this case, dampers (not shown in the figures) are disposed between the operator cabin 11 and the main body frame 9. Accordingly, if the front side of the operator cabin 11 is pulled upward after the connection between the operator cabin 11 and the main body frame 9 has been released, the operator cabin 11 swings upward about the pivot connection position; in this case, the dampers assist this swinging operation. An engine (not shown in the figures) which constitutes a driving source for the running apparatuses 5 and loader apparatus 20, a hydraulic pump (not shown in the figures) which is connected to this engine and the like are disposed inside the main body frame 9 so that these parts are positioned beneath the operator cabin 11. Accordingly, when the operator cabin 11 is swung upward, the engine, hydraulic pump and the like are exposed at the top, so that maintenance work on these parts is facilitated.

A pair of side part frames 9*a* which protrude upward are formed on the left and right side portions of the rear part of the main body frame 9. The abovementioned loader apparatus 20 is attached to these side part frames 9*a*. The loader apparatus 20 is constructed so that this apparatus comprises a pair of arms 21 which are respectively pivotably connected to the insides of the upper portions of the pair of side part frames 9*a*, a bucket 29 which is pivotably connected to the tip end portions of the pair of arms 21 so that this bucket 29 is free to swing, and raising and lowering cylinders 23 which are respectively installed on the pair of arms 21, and which raise and lower the arms 21. Each of the arms 21 has a straight part 21*a* which extends toward the front of the vehicle from the upper part of the corresponding side part frame 9*a*, and a bent part 21*b* which bends downward for some distance toward the front from the tip end portion of the straight part 21*a*; the straight part 21*a* and bent part 21*b* are formed as an integral unit. A step part 21*c* which extends downward is formed between the straight part 21*a* and bent part 21*b*.

The tip end portion of the cylinder rod end of the corresponding raising and lowering cylinder 23 is pivotably connected to the lower portion of this step part 21*c*, and the cylinder tube end portion of the raising and lowering cylinder 23 is pivotably connected to the lower portion of the corresponding side part frame 9*a*. When the abovementioned right operating lever 14*b* is operated by a tilting movement, the left and right raising and lowering cylinders 23 are extended or retracted in accordance with this operation so that the arms 21 are raised or lowered. When these arms 21 are not in operation, the arms 21 are usually lowered toward the front of the vehicle and placed in a state in which the arms extend in the forward-rearward direction and are inclined toward the front of the vehicle so that the tip end portions of the arms contact the ground (this is called the "stowed state") as shown in FIG. 1B.

A reinforcing member 25 which extends in the left-right direction is connected and attached to the left and right arms 21 between the bent parts 21*b* of the left and right arms 21. This reinforcing member 25 is positioned in front of the vehicle 10 when the arms 21 are in the abovementioned stowed state.

Figure 2:
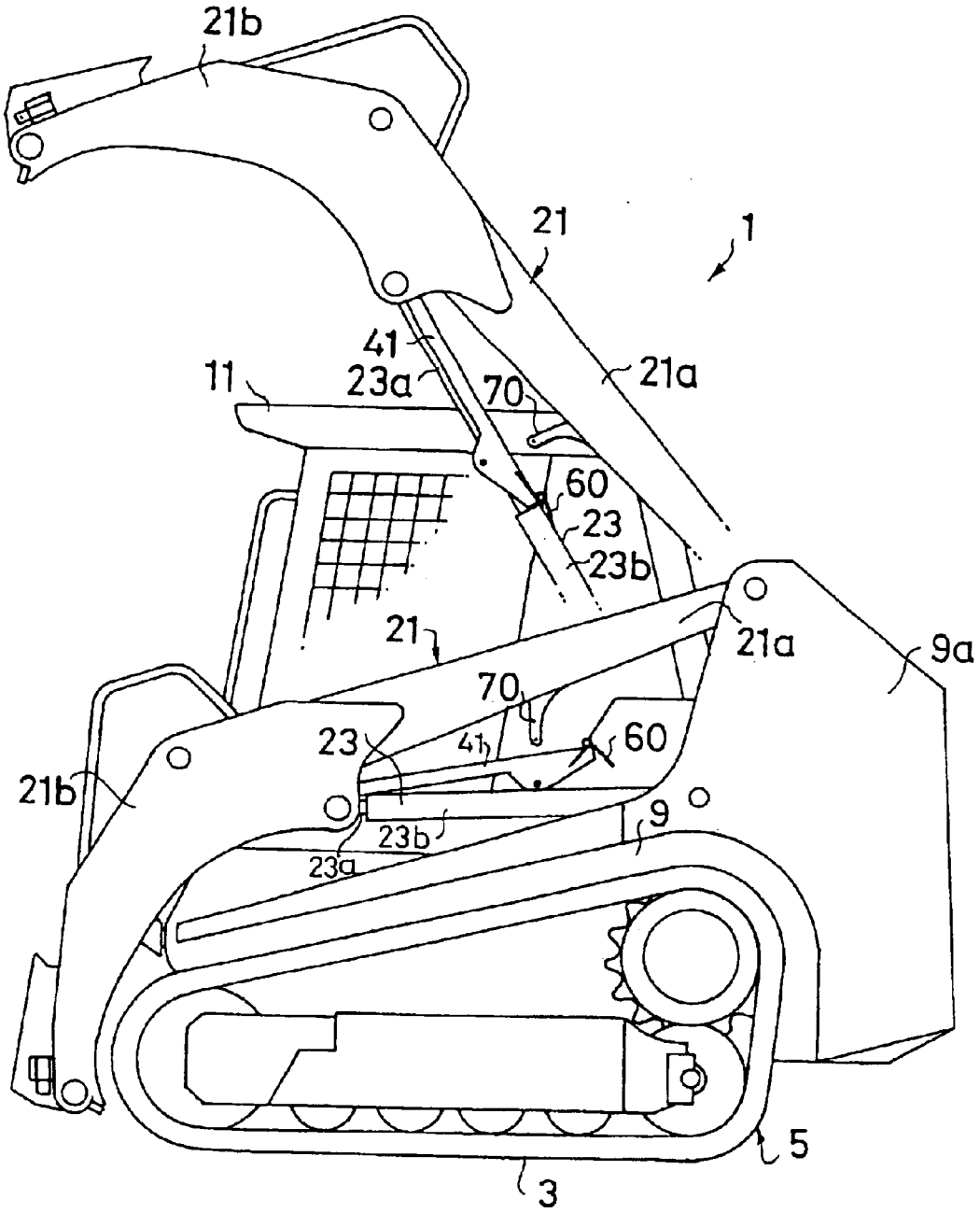
FIG. 2 shows a left side view of the shovel loader which is used to illustrate the operation of the arm lowering motion restricting device of the present invention.

Next, the arm lowering motion restricting device of the present invention which restricts the lowering motion of the arms in the abovementioned loader apparatus 20 will be described. As is shown in FIG. 2, the arm lowering motion restricting device 40 is a device which is used to mechanically restrict the lowering motion of the arms 21 when the arms 21 are in a raised state; this arm lowering motion restricting device 40 comprises an arm restricting member 41, a locking pin 50, and a torsion coil spring 60. Furthermore, one end portion of the arm restricting member 41 is pivotably connected to the step part 21*c* of the arm 21 on the left side of the vehicle (on the side of the viewer in FIG. 2), and the arm restricting member 41 extends through the space between this arm 21 and the corresponding raising and lowering cylinder 23 so that the upper surface of the raising and lowering cylinder 23 is covered; here, the arm restricting member 41 is free to swing upward and downward. Furthermore, as is shown in FIG. 3B, the locking pin 50 is detachably inserted into the lower portion of the tip end of the arm restricting member 41, and the torsion coil spring 60 is attached to the upper portion of the tip end of the arm restricting member 41.

Figure 3A:
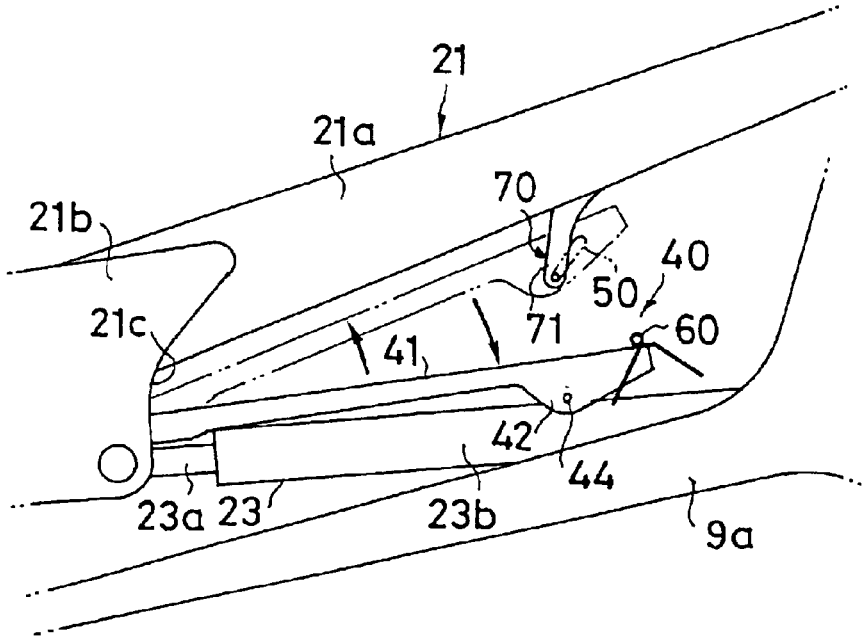
FIG. 3 shows diagrams which are used to illustrate the operation by which the lowering motion of the arm is restricted by the arm lowering motion restricting device of the present invention, with FIG. 3A being a side view of the arm lowering motion restricting device, and FIG. 3B being a perspective view of the arm lowering motion restricting device as seen at an inclination from below.
Figure 3B:
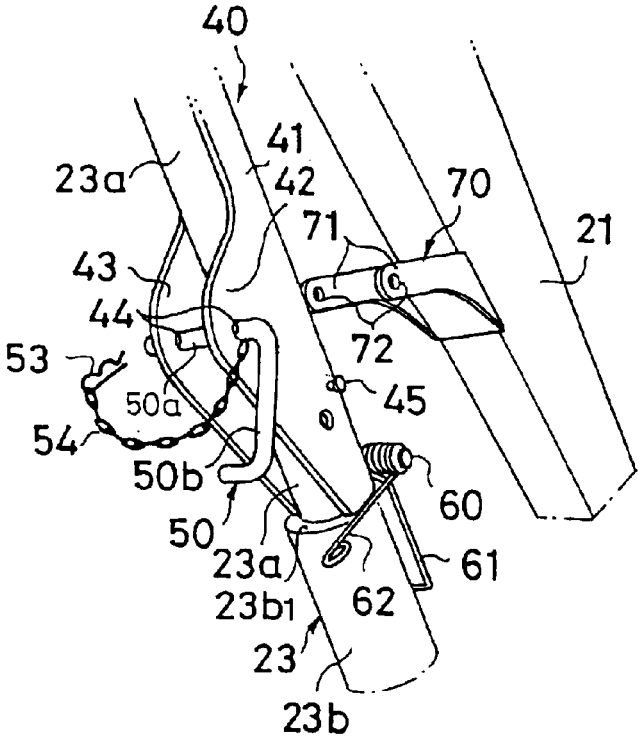

One end portion of the arm restricting member 41 is pivotably connected on the same axis as the pivot connection position of the cylinder rod 23*a* of the raising and lowering cylinder 23; as is shown in FIG. 3B, this end portion is formed with an inverted U-shaped cross section so that both the upper part and the left and right side parts of the cylinder rod 23 can be covered. A pair of protruding parts 42 and 43 which protrude downward are formed on the tip end portion on the other end of the arm restricting member 41. Through-holes 44 are formed in coaxial positions in the lower portions of the pair of protruding parts 42 and 43, and the through-holes 44 are positioned lower than the lower portion of the cylinder rod 23*a* in a state in which the arm restricting member 41 is placed on the cylinder rod 23*a*. Accordingly, as is shown in FIG. 3B, the locking pin 50 can be passed through the through-holes 44 in a state in which the arm restricting member 41 covers the cylinder rod 23*a* from above.

An latching pin 45 which protrudes to the outside in the horizontal direction is attached to the upper portion on the tip end side of the protruding part 42 that is disposed on the outside of the vehicle (of the two protruding parts 42 and 43). Furthermore, the operation of the latching pin 45 will be described later. The abovementioned torsion coil spring 60 is attached to the upper portion of the tip end of the arm restricting member so that this torsion coil spring 60 is free to pivot. In a free state, the torsion coil spring 60 is in a state in which a first arm part 61 on one side and a second arm part 62 on the other side extend perpendicular to each other. The second arm part 62 has a length which is such that the second arm part 62 can be latched on the latching pin 45. If the second arm part 62 is swung upward and latched on the latching pin 45 in a state in which the first arm part 61 is caused to contact the upper surface of the cylinder tube 23*b*, this results in a state in which the first arm part 61 is pressed against the top of the cylinder tube 23*b*, thus applying an urging force so that the upper portion of the tip end of the arm restricting member 41 is pulled upward.

Meanwhile, a bracket 70 which protrudes downward is attached to the undersurface of the arm 21 in a position facing the arm restricting member 41. The bracket 70 has a pair of supporting members 71 which are disposed facing each other across a gap that allows accommodation of the arm restricting member 41. Through-holes 72 which allow the locking pin 50 to be passed through are formed in the tip end portions of these supporting members 71.

The locking pin 50 has an insertion part 50*a* which can be passed through the through-holes 44 of the arm restricting member 41 and the through-holes 72 of the bracket 70, and a gripping part 50*b* which is connected to the insertion part 50*a*, and which extends after being bent at an angle from the insertion part 50*a*. A slip-out restricting pin 53 which prevents the locking pin 50 from slipping out of the through-holes 44 of the arm restricting member 41 in a state in which the locking pint 50 has been passed through the through-holes 44 is attached to the locking pin 50 via a chain 54.

Next, the operation of the arm lowering motion restricting device 40 constructed as described above will be described envisioning a case in which maintenance work is performed on the hydraulic pump or the like contained in the main body frame 9. When maintenance work is to be performed, the arms 21 are placed in the stowed state a shown in FIG. 1, and the bucket 29 is first removed from the arms 21. The reason for thus removing the bucket 29 from the arms 21 will be described later.

Next, the latching of the arm restricting member 41 attached to one of the arms 21 by the locking pin 50 is released. Specifically, as is shown in FIG. 3A, the locking pint 50 is pulled out of the arm restricting member 41 which is latched to the bracket 70 by the locking pin 50 (this state is indicated by a two-dot chain line), so that the fastening of the arm restricting member 41 to the bracket 70 is released. Then, the arm restricting member 41 is caused to swing downward, and is placed on top of the raising and lowering cylinder 23 as indicated by the solid line in FIG. 3A. In this case, it is confirmed that the torsion coil spring 60 is in a state that allows free pivoting. Specifically, it is confirmed that the second arm part 62 shown in FIG. 3B is not fastened to the latching pin 45.

Next, the operator (not shown in the figures) mounts to the operator cabin 11, and operates the right operating lever 14*b*, so that the arms 21 are slowly raised as shown in FIG. 2. Specifically, the raising and lowering cylinders 23 are slowing extended. When the raising and lowering cylinder 23 are extended, the cylinder rods 23*a* protrude from the cylinder tubes 23*b*, so that the arm restricting member 41 slides along the cylinder tube 23*b* of the corresponding raising and lowering cylinder 23 toward the cylinder rod. Then, when the tip end portion (lower end portion) of the arm restricting member 41 passes the end portion of the cylinder tube 23*b* on the side of the cylinder rod, the arm restricting member 41 covers to top of the cylinder rod 23*a* as shown in FIG. 3B. When the arm restricting member 41 thus covers the top of the cylinder rod 23*a*, the upper portion and left and right side portions of the cylinder rod 23*a* are covered by the arm restricting member 41.

Then, after the extended raising and lowering cylinders 23 have been temporarily stopped, the raising and lowering cylinders 23 are slowing retracted, so that the tip end portion (lower end portion) of the arm restricting member is caused to contact the end surface 23*b*1 of the corresponding cylinder tube 23*b* on the cylinder rod side. Furthermore, further retraction of the raising and lowering cylinder 23 from this state is prevented by the arm restricting member 41. Then, the engine is stopped, and the state of contact between the arm restricting member 41 and the end surface 23*b*1 on the cylinder rod side is maintained.

Next, the insertion part 50*a* of the locking pin 50 is passed through the through-holes 44 of the arm restricting member 41, so that the swinging motion of the arm restricting member 41 in the direction that causes the arm restricting member 41 to be separated from the cylinder rod 23*a* is prevented. Furthermore, the slip-out restricting pin 53 is fastened to the tip end portion of the locking pin 50 protruding from the through-holes 44 so that the locking pin 50 is prevented from slipping out of the arm restricting member 41. When a state is thus obtained in which the tip end portion of the arm restricting member 41 contacts the end surface of the cylinder tube 23*b* on the cylinder rod side, the arm restricting member 41 prevents the operation of the raising and lowering cylinder 23 even if the raising and lowering cylinder 23 tends to retract.

In this case, furthermore, if the bucket 29 shown in FIG. 1 is attached to the tip end portions of the arms 21, the magnitude of the force in the direction of retraction that acts on the arm restricting member 41 is increased, so that the size of the arm restricting member 41 must be increased. Accordingly, when the lowering motion of the arms 21 is to be restricted by the arm restricting member 41, the bucket 29 is removed from the arms 21 as described above.

In a state in which the lowering motion of the arms 21 is thus restricted by the arm restricting member 41, the operator pushes the operator cabin 11 and causes the operator cabin 11 to swing upward as shown in FIG. 2, so that the engine, hydraulic pump and the like (not shown in the figures) that are contained inside the main body are exposed at the top. Then, maintenance work is performed on these parts.

Figure 4B:
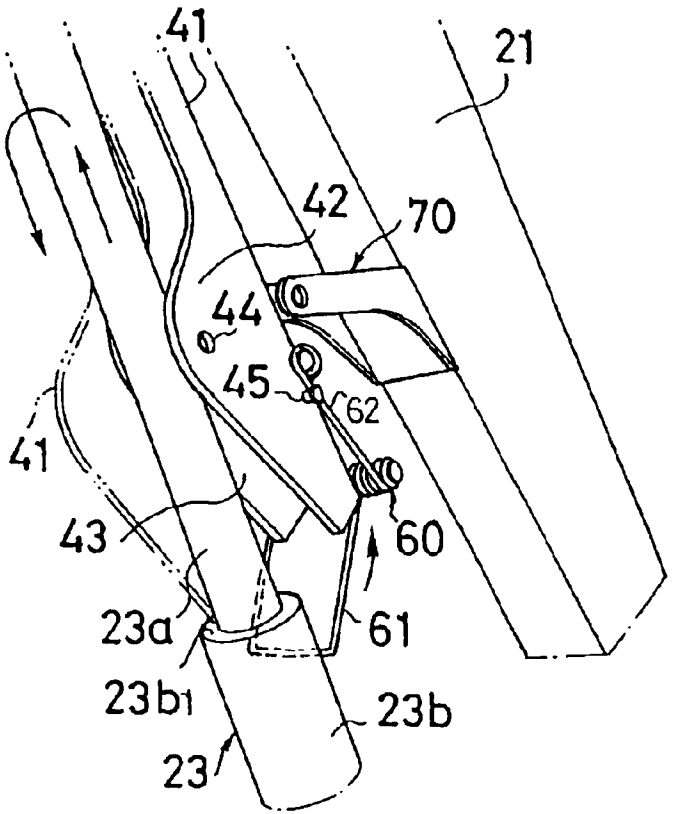
FIG. 4 is a perspective view of the arm lowering motion restricting device as seen at an inclination from below, which is used to illustrate the operation that releases the restriction of the arm lowering motion by the arm lowering motion restricting device of the present invention.
Figure 4A:
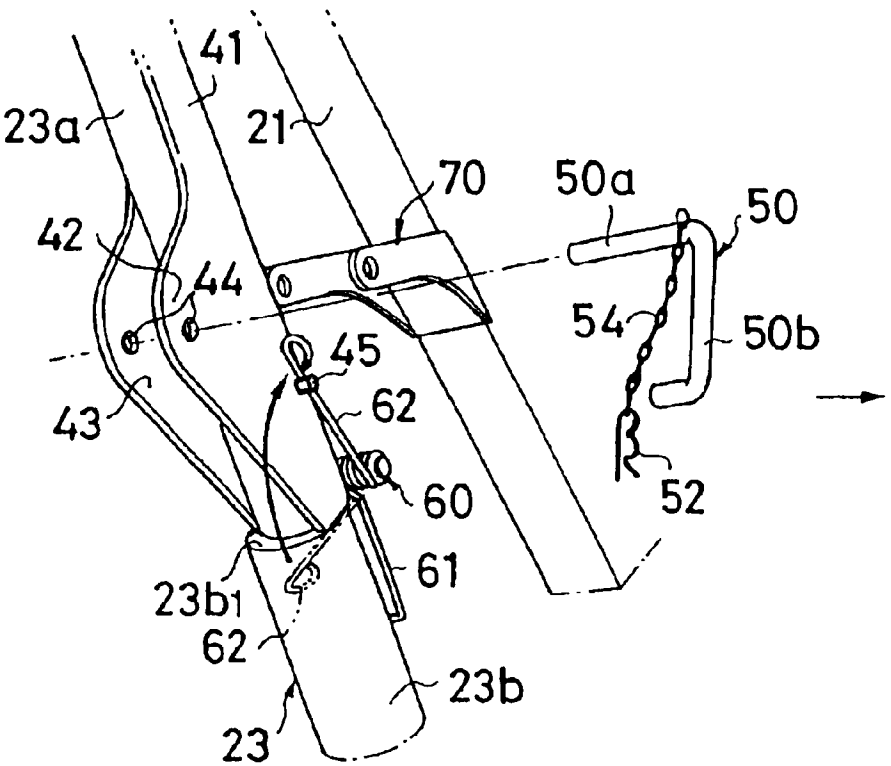

Next, the operation whereby the arms 21 are returned to the stowed position when the maintenance work has been completed will be described. First, the operator cabin 11, which has been swung upward, is swung downward and returned to its original position by the operator. Next, as is shown in FIG. 4A, after the slip-out restricting pin 53 has been removed from the locking pin 50, the locking pin 50 is pulled out of the arm restricting member 41. Then, with the first arm part 61 of the torsion coil spring 60 caused to contact the upper surface of the tip end of the cylinder tube 23*b*, the second arm part 62 is swung upward from the lower side of the tip end portion of the arm restricting member 41, and is latched to the latching pin 45. As a result, as is shown in FIG. 4B, the torsion coil spring 60 is placed in a state in which the first arm part 61 is pressed against the upper surface of the tip end of the cylinder tube 23*b*, so that the spring acts to pull the tip end portion of the arm restricting member 41 upward. However, since the frictional force that acts between the tip end portion of the arm restricting member 41 and the end surface 23*b*1 of the cylinder tube 23 on the cylinder rod side is large, the arm restricting member 41 does not swing upward.

Then, after the operator 11 has mounted to the operator cabin 11 and started the engine, the operator operates the right operating lever 14*b* so that the arms 21 are slowly raised. When the raising and lowering cylinders 23 are slowly extended, the tip end portion of the arm restricting member 41 which has been in contact with the end surface 23*b*1 of the corresponding cylinder tube 23 on the cylinder rod side is placed in a state of non-contact. As a result, the frictional force between the tip end portion of the arm restricting member 41 and the end surface 23*b*1 of the cylinder tube 23*b* on the cylinder rod side is eliminated, so that the arm restricting member 41 is pulled upward by the force of the torsion coil spring 60 (which acts to pull the arm restricting member 41 upward), thus releasing the restriction of the retraction of the raising and lowering cylinder 23. In this case, the position of the tip end portion of the arm restricting member 41 moves to a position that is above the end surface 23*b*1 of the cylinder tube 23 on the cylinder rod side.

Figure 1A:
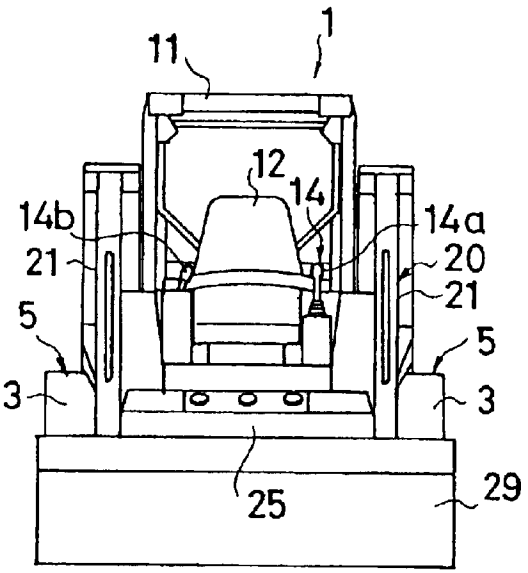

Then, when the operator who has mounted to the operator cabin 11 tilts the right operating lever 14*b* shown in FIG. 1A so that the arms 21 are lowered, thee raising and lowering cylinders 23 retract as shown in FIG. 3A without being hindered by the arm restricting member 41, and the arm restricting member 41 slides along the cylinder tube 23*b* of the corresponding raising and lowering cylinder 23 toward to the base part of the cylinder tube 23*b*, so that the arms 21 return to the stowed state shown in FIG. 2.

Then, after stopping the engine, the operator lifts the arm restricting member 41 upward, fastens the arm restricting member 41 to the bracket 70 by means of the locking pin 50, and fastens the slip-out restricting pin 53 to the locking pin 50. Afterward, the maintenance operation is completed by attaching the bucket 29 to the tip end portions of the arms 21 as shown in FIG. 1B.

Thus, when the restriction of the retraction of the raising and lowering cylinders 23 (i. e., the restriction of the lowering of the arms 21) is to be released, the operator need only anchor the second arm part 62 of the torsion coil spring 60 to the latching pin 45 in a state in which the tip end portion of the arm restricting member 41 is in contact with the upper surface of the tip end of the cylinder tube 23*b*, and then extend and retract the arms 21, so that the release operation is easy. Accordingly, there is no danger that the operator will make a mistake in the release operation, and the working efficiency of the release operation can be improved.

Furthermore, in the abovementioned embodiment, an example was shown in which the arm lowering motion restricting device was installed on one arm 21 (located on the side of the vehicle 10 facing the viewer in the figures) of the pair of arms 21. However, it would also be possible to mount such an arm lowering motion restricting device 40 on both arms 21.

In the arm lowering motion restricting device of the present invention, as was described above, since a torsion coil spring member is attached to the tip end portion of the arm restricting member, the arm restricting member can be caused to swing upward with respect to the raising and lowering cylinder (when the contact state of the arm restricting member is released) merely by pressing the first arm part of the torsion coil spring member against the upper surface of the tip end of the cylinder tube in a state in which the tip end portion of the arm restricting member is caused to contact the tip end surface of the cylinder tube, and attaching the second arm part of the torsion coil spring to a protruding part that is caused to protrude from the arm restricting member. Accordingly, the release operation that releases the restriction of the retraction of the raising and lowering cylinder by the arm restricting member can easily be accomplished.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arm lowering motion restricting device used in a working vehicle comprising a vehicle, an arm which is attached to said vehicle so as to be freely raised and lowered, and a raising and lowering cylinder which is attached between said vehicle and said arm to raise and lower said arm, in which the tip end of a cylinder rod constituting said raising and lowering cylinder is pivotably connected to said arm, and a cylinder tube constituting said raising and lowering cylinder is pivotably connected to said vehicle, so that said arm can be raised and lowered by extending and retracting said cylinder rod from and into said cylinder tube, wherein said arm lowering motion restricting device comprises:

an arm restricting member one end of which is pivotably connected to said arm, and which extends between said arm and said raising and lowering cylinder so as to cover the upper surface of said raising and lowering cylinder, and is free to swing upward and downward about the position where said one end is pivotably connected to said arm;

a swinging motion restricting member which restricts the swinging motion of said arm restricting member in the direction where said arm restricting member is separated from said cylinder rod in a state in which said arm restricting member has swung into a position where said arm restricting member covers the top of the cylinder rod; and a swinging motion urging member which is attached to the other end of said arm restricting member, and which urges said arm restricting member in the direction where said arm restricting member is separated from said cylinder rod in a state in which said arm restricting member has swung into a position where said arm restricting member covers the top of the cylinder rod.

2. The arm lowering motion restricting device according to claim 1, wherein said one end of said arm restricting member is pivotably connected on the same axis as the position where said cylinder rod is pivotably connected to the arm; and said arm restricting member is formed with an inverted U-shaped cross section that covers the upper portion and left and right side portions of said cylinder rod.

3. The arm lowering motion restricting device according to claim 1, wherein a pair of protruding parts that protrude downward are formed on the other end of said arm restricting member, through-holes which are positioned on the same axis extending in a direction perpendicular to the axis of said cylinder rod are formed in the lower portions of said pair of protruding parts, and said through-holes are positioned below said cylinder rod in a state in which said arm restricting member has been swung into a position where the arm restricting member covers said cylinder rod.

4. The arm lowering motion restricting device according to claim 3, wherein said swinging motion restricting member comprises a locking pin that is attached by being passed through said through-holes.

5. The arm lowering motion restricting device according to claim 1, wherein said swinging motion urging member is constructed from a torsion coil spring that is attached to the other end of said arm restricting member, a first arm part 61 on one side of said torsion coil spring contacts the upper surface of said raising and lowering cylinder, a second arm part on the other side of said torsion coil spring is latched to said arm restricting member, and said arm restricting member is urged by the force of said torsion coil spring in the direction where said arm restricting member is separated from said raising and lowering cylinder.

6. The arm lowering motion restricting device according to claim 5, wherein the latching between said second arm part and said arm restricting member can be released.

7. The arm lowering motion restricting device according to claim 1, wherein a bracket that protrudes downward is disposed on the undersurface of said arm in a position facing said arm restricting member, and said arm restricting member can be latched to said arm by latching said arm restricting member to said bracket.

8. The arm lowering motion restricting device according to claim 1, wherein said arm restricting member covers said cylinder rod when the amount of extension of said raising and lowering cylinder reaches a specified amount, and the retraction of said raising and lowering cylinder can be restricted as a result of the other end portion of said arm restricting member abutting against the tip end surface of said cylinder tube.

* * * * *